US006002388A

United States Patent [19]

Seffernick et al.

[11] Patent Number: 6,002,388

[45] Date of Patent: Dec. 14, 1999

[54] POINTING STICK HAVING A FLEXIBLE INTERPOSER

[75] Inventors: Lewis L. Seffernick, Decatur; Robert M. VandenBoom, Markle, both of Ind.

[73] Assignee: CTS Corporation, Elkhart, Ind.

[21] Appl. No.: 09/149,713

[22] Filed: Sep. 9, 1998

Related U.S. Application Data

[63] Continuation-in-part of application No. 08/794,703, Feb. 4, 1997, abandoned.

[51] Int. Cl.[6] ..... G09G 5/08

[52] U.S. Cl. ..... 345/161; 345/168; 345/156; 345/157; 74/471 XY; 341/22

[58] Field of Search ..... 345/156, 157, 345/161, 168; 74/471 XY; 341/22

[56] References Cited

U.S. PATENT DOCUMENTS

| | | | |
|---|---|---|---|
| Re. 35,016 | 8/1995 | Gullman et al. . | |
| 4,680,577 | 7/1987 | Straayer et al. . | |
| 4,876,524 | 10/1989 | Jenkins . | |
| 4,905,523 | 3/1990 | Okada . | |
| 4,967,605 | 11/1990 | Okada . | |
| 4,969,366 | 11/1990 | Okada . | |
| 5,263,375 | 11/1993 | Okada . | |
| 5,325,081 | 6/1994 | Roberts | 345/161 |
| 5,407,285 | 4/1995 | Franz . | |
| 5,473,347 | 12/1995 | Collas et al. . | |
| 5,489,900 | 2/1996 | Cali et al. | 341/34 |
| 5,521,596 | 5/1996 | Selker et al. . | |
| 5,594,618 | 1/1997 | Sellers | 361/680 |
| 5,659,334 | 8/1997 | Yaniger et al. | 345/156 |
| 5,689,285 | 11/1997 | Asher | 345/161 |
| 5,704,791 | 1/1998 | Gillo | 434/262 |

FOREIGN PATENT DOCUMENTS

| | | |
|---|---|---|
| 2290600 | 3/1996 | United Kingdom . |

*Primary Examiner*—Julie Lieu
*Attorney, Agent, or Firm*—Mark P. Bourgeois

[57] ABSTRACT

A pointing device for controlling the positioning, movement and operation of a cursor on a display screen. Specifically, there is an actuator with a shaft having first and second ends. The actuator also has an interposer with the first end of the shaft attached and several strain sensitive resistor are mounted on the shaft to generate an electrical signal representative of a magnitude and direction of force applied to the shaft by a user. A circuit trace is disposed on the interposer and electrically connected to the resistor. A substrate has several circuit lines electrically connected to the circuit trace. A base is mounted above the interposer and has an aperture through which the shaft passes. A cover is mounted over the base to hold the base to the substrate. The cover is held to the substrate by a mounting tab.

8 Claims, 3 Drawing Sheets

POINTING STICK HAVING A FLEXIBLE INTERPOSER

This application is a continuation in part of U.S. application Ser. No. 08/794,703 now abandoned filed Feb. 4, 1997 and is herein incorporated by reference.

This application is related to U.S. application Ser. No. 08/756,202, entitled Z-axis sensing pointing stick with base as strain concentrator, filed Nov. 25, 1996, and U.S. application Ser. No. 08/717,517 now U.S. Pat. No. 5,894,301 entitled Collar Mounted Pointing Stick, filed Sep. 23, 1996. Both applications being assigned to the current assignee of this application and are herein incorporated by reference in their entirety.

BACKGROUND OF THE PREFERRED EMBODIMENT(S)

1. Field of the Preferred Embodiment(s)

This invention generally relates to a pointing device for controlling the positioning, movement and operation of a cursor on a display screen. Specifically, there is a pointing stick that both directs a cursor and acts as the activation button for selecting items on the display screen by tapping on the pointing stick instead of clicking on a mouse button. The pointing stick has a flexible film interposer that connects to an external electrical circuit.

2. Description of the Related Art

Various devices are well known for controlling cursor movement over a computer display screen of a computer and for signaling a choice of computer command identified by the position of the cursor on the display screen menu. One such device is a "mouse" which has a ball on its underside rolled over a horizontal surface, with the x- and y-axis components of movement being sensed and transmitted through a connecting cable to a serial input port of the computer. The signal to the computer is varied by the amount and direction of movement of the mouse ball, and causes the cursor on the display screen to have a corresponding movement. One or two "mouse" or "click" buttons located on the top of the mouse at the forward end permit the computer operator to enter a selection or other command to the computer (the command typically being shown by the position of the cursor on a displayed menu) upon pressing one or the other or both buttons, depending upon the software associated with the device. Such a device, which is separate from the computer console and keyboard and requires a connection to a computer port, requires a flat, horizontal surface, and for operation of the mouse, the computer operator must completely remove one hand from the computer keyboard.

Another cursor controlling and signaling mechanism is a "joystick" which like the mouse is completely separated from the computer console and keyboard. The joystick is typically an elongated stick that extends upwardly from a base connected to the computer console by means of a cable. The joystick is operated by tilting the upstanding stick in various directions to cause the cursor or other display element to move in a direction and usually at a speed corresponding to the direction and pressure exerted on the stick by the computer operator. The operation of a joystick, however, frequently requires that both hands be removed from the computer keyboard, one hand to hold the base while the other manipulates the joystick. A "click" button is usually located on the joystick. Although a mouse or a joystick can be used with a portable "laptop" or "notebook" size computers, such devices are cumbersome, must be carried separately and connected to the computer before use, and are not suitable for operation during travel.

Still, another type of cursor controlling device is a "trackball." This device, which in essence is an inverted mouse, includes a rotatable ball mounted within a housing. The ball is rotated by a finger, thumb or palm of the computer operator, and the x- and y-components of movement are sensed and input into the computer to cause corresponding movement of the cursor across the display screen. "Mouse" or "click" buttons are usually located on the trackball housing, although with some models the selection signal is input by pressing the "enter" key on the standard keyboard. This type of pointing device has been found useful with portable computers because it can be temporarily affixed to one side of the computer case for manipulation by one hand of the computer operator. However, although trackball devices can be removably attached to the computer case, they still require attachment before use and removal after use. It is also noted that some trackballs are built into the computer keyboard. Nonetheless, these trackballs require a separate set of "click" buttons for selection of items on the display monitor.

Manufacturers of portable laptop computers, recognizing the need for placing the cursor controlling device in a permanent and more convenient location, installed a small stubby, button-like joystick centrally around the keys of the computer keyboard, specifically at the juncture of the "g," "h" and "b" keys of the standard "QWERTY" keyboard. The joystick, also known as a pointing stick, was sensitive to lateral pressure, the amount and direction of which were sensed and input into the computer to cause movement of the cursor, and the speed and direction of cursor movement corresponded to the amount and direction of pressure on the joystick. However, the manufacturer has to provide upwardly extending "mouse" or "click" buttons somewhere on the computer.

Despite the advantages of each type of cursor control, none have allowed the user to both control the cursor movement and select items on the display using exclusively a pointing stick device. Additionally, no prior art allows the user this dual control by using only one finger while allowing the remaining fingers to reside on the home row of the standard keyboard.

Additionally, the prior art devices have been difficult to incorporate into a printed circuit board along with other electronic functions.

DESCRIPTION OF RELATED ART

Examples of patents related to the present invention are as follows, wherein each patent is herein incorporated by reference for related and supporting teachings:

U.S. Pat. No. Re. 35,016, is a three-axis force measurement stylus.

U.S. Pat. No. 5,489,900, is a strain sensitive columnar transducer for a data entry keyboard contains a column upstanding from the keyboard.

U.S. Pat. No. 5,521,596, is a sensor device placed either underneath a key cap or a key on a keyboard or between two keys on a keyboard so that cursor movement may be carried out from the keyboard itself.

U.S. Pat. No. 5,473,347, is a computer pointing device for controlling the positioning, movement and operation of a cursor on the display screen of a computer.

U.S. Pat. No. 5,407,285, is an apparatus for use in a computer keyboard for cursor control is disclosed.

U.S. Pat. No. 5,325,081, is a supported strain gauge and joy stick assembly and method of making.

U.S. Pat. No. 5,263,375, is a contact detector using resistance elements and its application.

U.S. Pat. No. 4,969,366, is a moment detector using resistance elements.

U.S. Pat. No. 4,967,605, is a detector for force and acceleration using resistance elements.

U.S. Pat. No. 4,905,523, is a force detector and moment detector using resistance elements.

U.S. Pat. No. 4,876,524, is an isometric control device or the like of the type having an elastic beam and strain gauges attached to the surface of the beam characterized by at least a first group of three strain gages each having an operative axis thereof inclined with a single predetermined angle with respect to the main axis of the beam, and the strain gauges disposed at a first predetermined level along the beam.

U.S. Pat. No. 4,680,577, is a multipurpose key switch for controlling cursor movement on a CRT display and for character entry includes a key cap that moves laterally to provide cursor control and that moves vertically for character entry.

The foregoing patents reflect the state of the art of which the applicant is aware and are tendered with the view toward discharging applicants' acknowledged duty of candor in disclosing information that may be pertinent in the examination of this application. It is respectfully stipulated, however, that none of these patents teach or render obvious, singly or when considered in combination, applicants' claimed invention.

PROBLEMS WITH THE PRIOR ART

There are several problems that exist with the prior art that are addressed by the preferred embodiment. One problem for pointing stick developers is to deal with seffernick forces. Seffernick forces are those forces that are applied to a supporting structure, a keyboard for example, that are translated to the pointing stick. For example, typing on a keyboard can generate seffernick forces. In that case, the pointing stick is so sensitive that a user would be activating the pointing stick operation unintentionally. The sensitive electronics on the pointing stick would sense the deformation of the keyboard support surfaces and translate that into deformation of its own support surface and mistakenly generate control signals. Thus, seffernick forces are those forces that are translated from a support structure through the body of the pointing stick and to the electronic components of the pointing stick sufficient to generate unintentional control signals.

Another problem with the prior art pointing sticks is the lack of ESD (electrostatic discharge) protection. Users of keyboards, for example, often build up static electricity that is discharged to the sensitive electronics on the pointing device. If the pointing device receives ESD energy the sensitive electronics of not only the pointing stick but also the keyboard or even the associated computer components could be damages.

Another problem is that the current pointing sticks are not easily integrated into standard electronic packages such as printed circuit boards.

These and other problems will be solved by the preferred embodiments of the invention. A review of the specification, drawings, and claims will more clearly teach a skilled artisan of other problems that are solved by the preferred embodiments.

SUMMARY OF THE PREFERRED EMBODIMENT(S)

It is a feature of the invention to provide a pointing stick for controlling the positioning, movement and operation of a cursor on the display screen.

A further feature of the invention is to provide a pointing stick assembly using resistor based strain gages mounted on the sides of the shaft of the pointing stick. Wherein, the strain gages are for sensing when either the stick or base is being bent. Upon bending, strain is created on the resistor based strain gages. Wherein, the strain gages are coupled to circuitry that will produce signals in response to the strain on the gages. The resulting signals are used to either control the movement of the cursor around the display screen, or to do what is commonly called "clicking" a mouse button for selection of items or dragging of items on the display screen.

A further feature of the invention is to provide a device for generating electrical signals responsive to a users actuation thereof having an actuator with shaft having first and second ends. The actuator also has an interposer with the first end of the shaft attached and several strain sensitive resistor are mounted on the shaft to generate an electrical signal representative of a magnitude and direction of force applied to the shaft by a user. A circuit trace is disposed on the interposer and electrically connected to the resistor. A substrate has at least one circuit line electrically connected to the circuit trace.

A base is disposed above the interposer and has an aperture through which the shaft passes and a cover is disposed over the base for holding the base to the substrate. The cover is held to the substrate by a mounting tab. The interposer can be a polyamide film and the substrate can be a printed circuit board.

A further feature of the invention is to provide an easy method or design for coupling the electrical traces located on the flexible interposer to the resistor based strain gages.

The invention resides not in any one of these features per se, but rather in the particular combination of all of them herein disclosed and claimed. Those skilled in the art will appreciate that the conception, upon which this disclosure is based, may readily be utilized as a basis for the designing of other structures, methods and systems for carrying out the several purposes of the present invention. Further, the abstract is neither intended to define the invention of the application, which is measured by the claims, neither is it intended to be limiting as to the scope of the invention in any way.

BRIEF DESCRIPTION OF THE DRAWINGS

These and other features of the invention can best be understood by the following description of the accompanying drawings as follows.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. The invention will be described with additional specificity and detail through the accompanying drawings.

DETAILED DESCRIPTION OF THE PREFERRED EMBODIMENT

Figure 1:
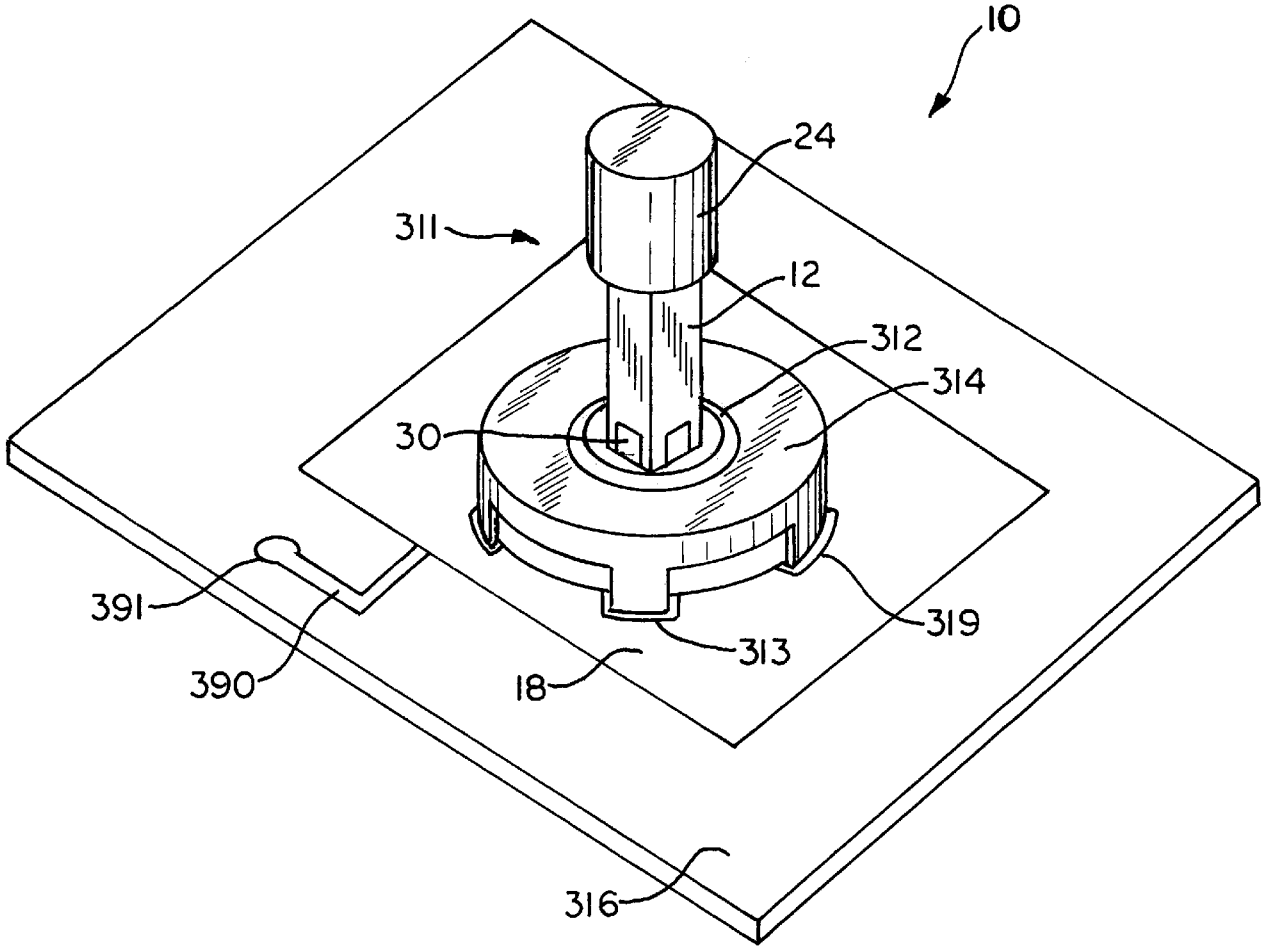
FIG. 1 is a perspective view of the preferred embodiment.

Referring to FIG. 1, there is a perspective view of the preferred embodiment of the invention. Specifically, there is pointing stick 10 having a post assembly 311. The post assembly 311 is made up of the ceramic post 12, a plastic base 312 for mounting the post therein, and a flexible interposer or film 18. Film 18 routes signals from post 12 to a substrate 316 with signal conditioning circuitry (not shown). Substrate 316 is typically a printed circuit board having circuit lines 390 and surface mount pads or through holes 391. Of course, the post assembly components are fixedly attached to each other to form a unitary body. Post 12 has strain gages 30 (electrical circuit) mounted thereon, and a plastic cap 24 positioned over the post for use by a keyboard user to direct the movement of a cursor on a computer display, for example. There is also a cover 314 which includes a mounting tab 313 for attaching the cover to substrate 316. Substrate 316 serves as a base for mounting the whole pointing stick assembly 10 thereto. The cover 314 is preferably formed from a conductive metal or material and connected to ground so that it can direct any electrostatic discharges away from the pointing stick 10.

Figure 2:
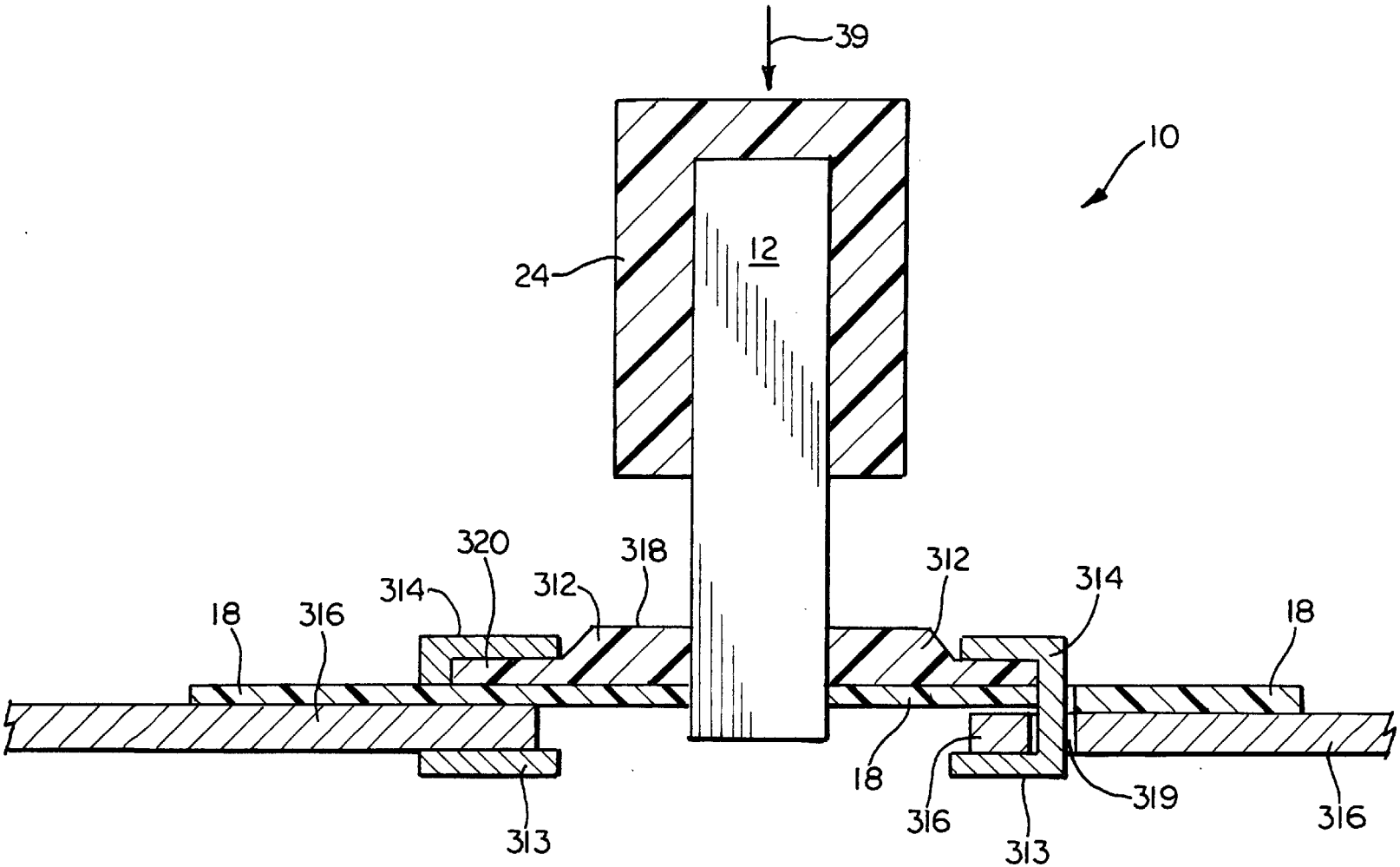
FIG. 2 is a cross sectional view of FIG. 1.

Referring to FIG. 2, there is a cross sectional view of FIG. 1. Specifically, base 312 has a collar 318 that protrudes from cover 314, and a second section 320 that fits under cover 314. Flexible film 18 is located between base 312 and a substrate 316. Substrate 316 has holes 319 therein for inserting tabs 313 therethrough, which are thereby bent upon being inserted into the position illustrated to hold the assembly together. Substrate 316 is typically mounted upon a structure, like a keyboard (not shown).

Figure 3:
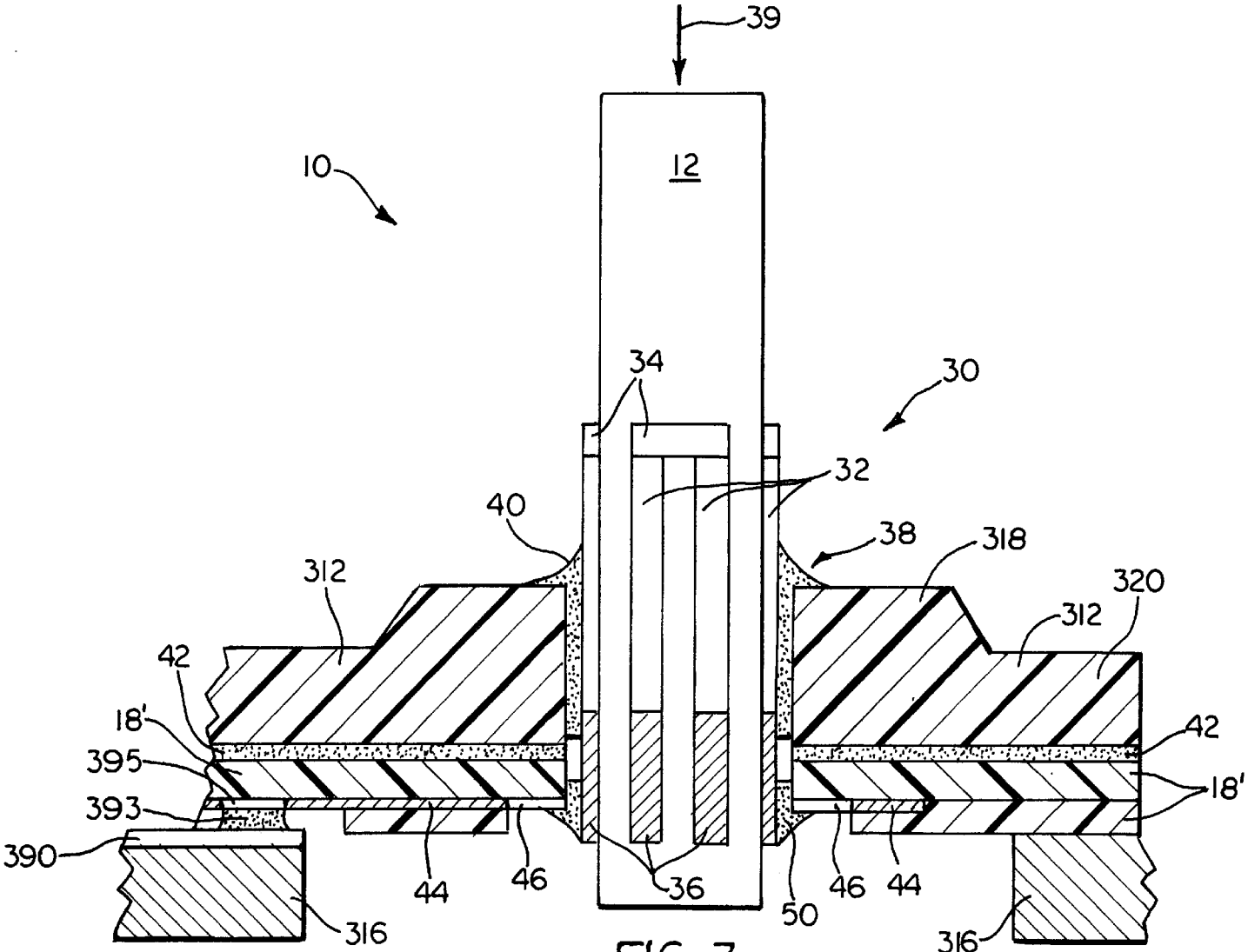
FIG. 3 is a cross sectional view of FIG. 1 illustrating a close up view of the operational assembly.

Referring to FIG. 3, there is a cross-sectional view of FIG. 1 taken through film 18 and along the one side of the stick 12. In particular, the following additional elements are illustrated: Strain gages 30 are mounted on the sides of stick 12 and are made of pressure sensitive strips or resistors 32, for electrically changing the resistance of the material in response to the amount of strain applied thereto, a conductive contact bridge 34 for electrically connecting the two strips 32, and conductive contact pads 36 for making electrical contacts. A suitable material for flex film 18 is a polyamide film, also known as a flexible printed circuit is commercially available from several sources such as Fujikura or Sheldahl Corporation. Film 18 has electrical traces 44 and input/output (I/O) pads 46 mounted between the two insulative layers 18'. The insulative film layers insulate the traces from substrate 316. Stick 12 extends through hole 38 in a z-axis direction 39, and is held in place by an adhesive bond epoxy 40. For example, a cyanoacrylate adhesive material is also suitable for bonding. Contact pads 36 are bonded to I/O pads 46 by any suitable bond material 50, like tin-lead solder. It is noted that only the post assembly is bonded together. An optional adhesive 42 may be placed between base 312 and flexible film 18. Film 18 has further I/O pads 395 which are attached to another end of electrical traces 44. Substrate 316 has circuit lines 390, part of which are disposed below pads 395. Circuit lines 390 are electrically connected to I/O pads 395 by any suitable bond material 393, like tin-lead solder.

Pointing stick 10 can be assembled as follows: The first step usually involves either the screening of resistive and conductor thick film or the sputtering of resistive and conductor thin film material on the sides of stick 12. The screened on material forms strain gages 30. The second step often involves the placement of stick 12 into the base 312 (or base) and the bond material 40. Material 40 is an epoxy placed to bond the film 18, the stick 12 and base 312. Thereafter, usually flexible film 18 is attached. Next, the solder material may be placed around stick 12 to attach all eight I/O pads 46 to all eight contact pads 36, two on each side of stick 12. Solder paste is screened onto circuit lines 390 and stick assembly 10 is placed on top with pads 395 aligned over lines 390 and then run through a reflow furnace to melt the solder paste and form solder joint 393. Hot bar soldering could also be used. Cover 314 is placed over the assembly with tabs 313 extending through holes 319 and bent over. Cover 314 is thereby attached by tabs 313, thus holding the post assembly therein. Cap 24 is placed on the top of stick 12.

REMARKS ABOUT THE PREFERRED EMBODIMENTS

One of ordinary skill in the arts of strain gages and ceramic materials, and more particularly the art of designing pointing sticks with strain gages on the sides, will realize many advantages from using the preferred embodiment. In particular, strain gages are devices that sense the amount and of applied pressure placed upon the pointing stick. The sensed pressure creates electrical output signals used to direct the cursor on a display device. Thus, the side mounted strain gages enables control of both the directions of the cursor movement and the selection of items on the display device by tapping the pointing stick like the clicking of a mouse button. Of course, a skilled artisan will realize that the base 312 may have some flexure in a downward direction during the application of tapping force. Specifically, the flexing of base 312 will cause some force to be applied to the sensor from the top portion of the walls of hole 38.

Additionally, a skilled artisan will understand that the strain gages may be made of thick films piezo-resistive material, which are applied using known screen techniques.

It is further noted that a skilled artisan would realize that pointing stick 10 is capable of now performing selection and dragging of icons on a monitor in addition to double clicking for selection of an item. In this operation, the user would hold down the pointing stick 10 while exerting additional force in the X-Y plane for controlling the direction of the icon being dragged. All of these functions are now capable of being performed with a single finger while the remaining fingers are inactively located on a home row of the keyboard. The home row being the keys marked "a, s, d, f, j, k, l, and ;" as typically referred to in typing manuals.

One of ordinary skill in the arts of strain gages will realize that collar 318 will increase or focus the strain created from movement of shaft 12, along the length of the strain gages. In particular, the shorter section 320 would not provide a large enough surface area contact on the strain gages to generate large enough signals for detection.

The flexible film 18 is readily attached to substrate 316 by conventional printed circuit board assembly techniques.

Variations of the Preferred Embodiment(s)

One of ordinary skill in the art of making pointing stick will realize that there are many different ways of accomplishing the preferred embodiment. For example, it is contemplated to make the shaft 12 and substrate 312 out of any suitable material, like ceramic material, plastics, epoxy resin, or metals etc. Additionally, although bonding compound 40 is illustrated to be placed between the base 312 and the stick 12, it may not be required when hole 38 fits securely around stick 12. This is equally true for material 50 if the flexible film 18 fits securely around stick 12, in which only a small amount of solder may be needed to enhance electrical contact therebetween.

Even though, the embodiment discusses the use of strain gages on all four sides of stick 12, it is contemplated to use only two sides of the stick 12 for sensing only either the positive or negative strain on the bending of the stick for creating the resulting control signals.

Similarly, even though the embodiment discusses the use of a cursor on a monitor, one skilled in the computer arts would realize that any item that can be moved around by the typical mouse may be controlled by the preferred embodiment. For example, pointing arrows, icon selection items, air planes, boats, cats, pictures of atoms, all could have their movements controlled.

Although, the base 312 is illustrated in FIG. 3 as having a large step between the collar 318 and the second portion 320, it is contemplated to have many designs for the transition. For example, it is possible to have a ramping, or even to have second section 320 to be the same thickness as collar 318.

Additionally, flexible film 18 could be made of a more rigid material such as a printed circuit board or FR4 material. Similarly, substrate 316 was described to be a printed circuit board, whereby, it could be either a flex circuit board or a ceramic substrate, for example.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by Letters Patent is:

1. A device for generating electrical signals representative of forces applied in an x, y and z-axis, the device being responsive to a users actuation thereof, comprising:

a) a shaft, having a first and second end;

b) a flexible interposer having the first end attached thereto;

c) a strain sensitive resistor, mounted on the shaft, for generating an electrical signal representative of a magnitude and direction of a force applied to the shaft by the user;

d) a circuit trace disposed on the interposer and electrically connected to the resistor; and e) a substrate having a circuit line thereon, and electrically connected to the circuit trace such that the user actuating the device in the z-axis causes the interposer to flex, the flexing of the interposer providing a feedback to the user;

f) a base disposed above the interposer, surrounding the shaft and having an aperture through which the shaft passes, the base having a collar, extending above the base for concentrating forces from the shaft onto the strain sensitive resistor when the shaft is moved in the x, y and z-axes by the user.

2. The device according to claim 1, wherein a cover is disposed over the base for holding the base to the substrate.

3. The device according to claim 2, wherein the cover is held to the substrate by at least one mounting tab.

4. A device for generating electrical signals in response to forces applied thereon by an operator, the device operable to be connected to an external circuit, comprising:

a) an actuator, having a plurality of strain sensitive resistors mounted on the actuator for generating an electrical signal representative of force applied thereon;

b) a substrate, having the actuator mounted thereon;

c) a base mounted above and surrounding the actuator and having an aperture through which the actuator passes, the base having a collar, extending above the base for concentrating forces from the actuator onto the strain sensitive resistor when the shaft is moved by the user; and d) a cover, disposed over the base for holding the base and the actuator to the substrate;

e) a flexible interposer attached to the actuator and located between the substrate and the cover, the interposer allowing the actuator to flex in response to forces applied thereon by the operator, the flexing of the interposer providing a feedback to the operator.

5. The device according to claim 4, wherein the actuator has a shaft with the resistors mounted thereon, the shaft having a first and second end.

6. The device according to claim 4, wherein the cover is held to the substrate by at least one mounting tab.

7. The device according to claim 4, wherein the cover is metallic for discharging electrostatic discharge.

8. The device according to claim 7, wherein the cover is grounded.

* * * * *